United States Patent [19]

Haneda et al.

[11] Patent Number: 4,632,064

[45] Date of Patent: Dec. 30, 1986

[54] BOILER

[75] Inventors: Hisao Haneda; Mamoru Araoka, both of Tokyo, Japan

[73] Assignee: Mitsubishi Jukogyo Kabushiki Kaisha, Tokyo, Japan

[21] Appl. No.: 760,979

[22] Filed: Jul. 31, 1985

[30] Foreign Application Priority Data

Nov. 30, 1984 [JP] Japan ..... 59-251987

[51] Int. Cl.[4] ..... F22B 33/00

[52] U.S. Cl. ..... 122/1 A; 122/1 B; 110/162

[58] Field of Search ..... 122/1 A, 1 B, 7 R; 110/162, 163

[56] References Cited

U.S. PATENT DOCUMENTS

| | | | |
|---|---|---|---|
| B 204,161 | 1/1975 | Weinman et al. | 110/162 |
| 2,744,733 | 5/1956 | Howes | 122/1 A |
| 2,795,213 | 6/1957 | Cooper | 122/1 A |
| 3,076,422 | 2/1963 | Spalding | 122/1 A |
| 4,245,569 | 1/1981 | Fallon, III | 110/162 |
| 4,403,571 | 9/1983 | Kochey, Jr. | 122/1 A |

FOREIGN PATENT DOCUMENTS

| | | | |
|---|---|---|---|
| 2935762 | 4/1981 | Fed. Rep. of Germany | 122/1 A |
| 932103 | 5/1982 | U.S.S.R. | 122/1 A |

*Primary Examiner*—Henry C. Yuen

*Attorney, Agent, or Firm*—Wenderoth, Lind & Ponack

[57] ABSTRACT

A boiler having a discharge gas duct divided into a plurality of passages, respective passages having reheaters and superheaters therein. Gas flow controllers are provided for adjusting combustion gas flow through the respective passages. Evaporators are provided in the passages which have reheaters therein, the convective evaporators being downstream of the respective reheaters.

2 Claims, 1 Drawing Figure

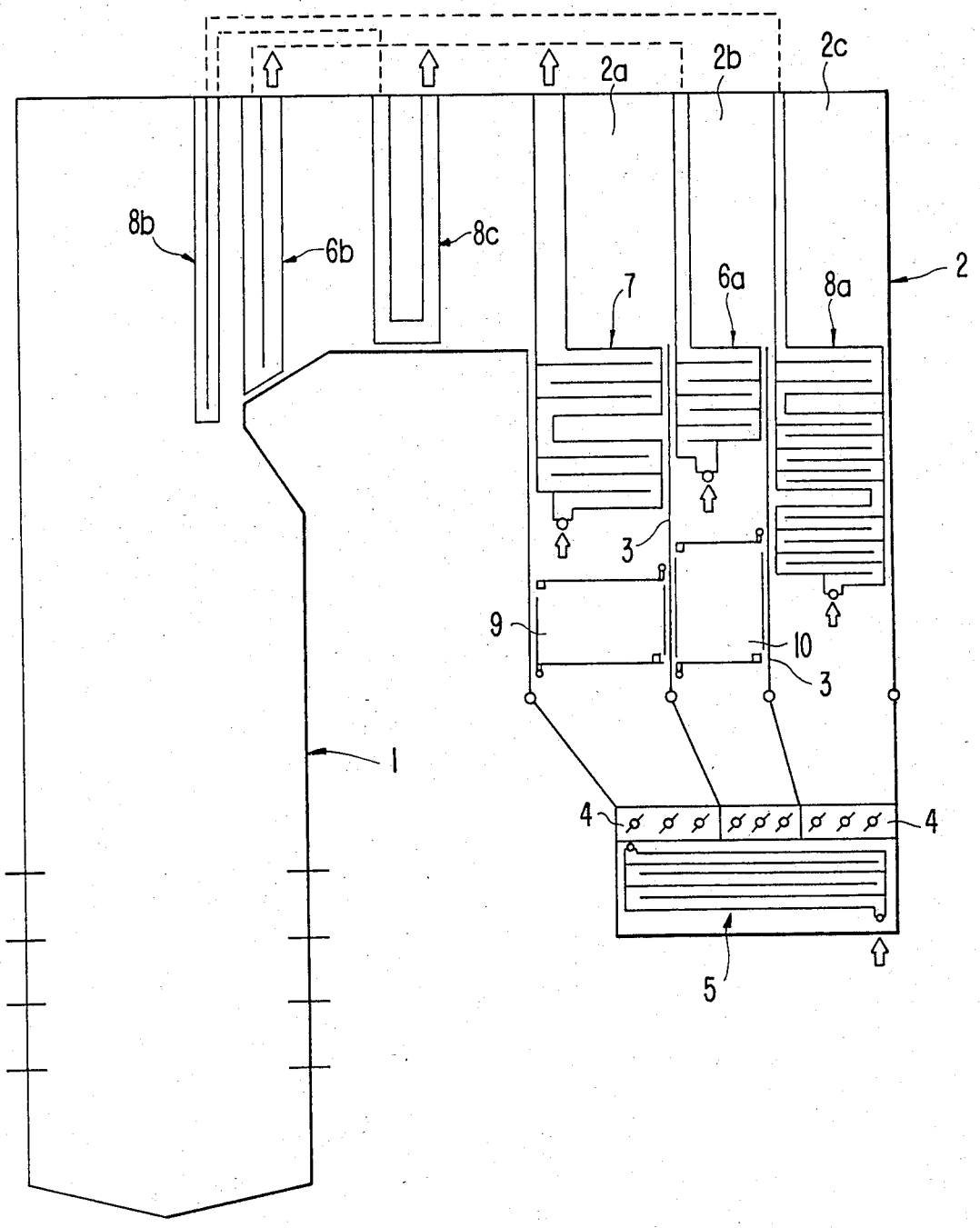
2a
2b
2c
8b
6b
8c
7
6a
8a
2
3
9
10
3
1
4
4
5

BOILER

BACKGROUND OF THE INVENTION AND PRIOR ART

The present invention relates to an improved boiler wherein a combustion gas duct is divided into a plurality of passages, the separate passages being provided with reheaters and superheaters, and the amount of combustion gas which flows through the passages to the discharge end thereof is adjustable by means of dampers provided at the outlet ends of the passages.

In prior art boilers with reheaters incorporated therein, known as reheat boilers, a damper control system has been utilized as one system for controlling reheat steam temperatures. In this system, the gas duct is divided into a plurality of passages. The separate passages are provided with reheaters and superheaters. In addition, a damper is provided at the outlet end of each passage. With this arrangement, the amount of combustion gas flowing through each passage is adjusted by controlling the opening of the dampers, thereby controlling the heat absorption by the reheater, and thus controlling the reheat steam temperatures.

During a the rapid load down or in case actual operating conditions are different from planned operating conditions, reheaters must absorb a greater amount of heat than planned. In such a case, the opening of the dampers is so controlled as to direct more combustion gas into the passages with the reheaters provided therein. On the other hand, the amount of combustion gas flowing through the passages with the superheaters provided therein is naturally decreased. As a result, the heat absorption by the superheaters decreases control of steam temperatures at the outlet of each of the superheaters which is effected by a fuel-feed water ratio control system. Accordingly, as the heat absorption by the superheaters decreases, more fuel is supplied to the furnace for compensating purposes. However, in the event that a temperature exceeds certain tolerance limits, the water-wall tubes constituting the furnace are subject to thermal strain due to large temperature differences thereacross. A problem arises of protecting the furnace.

OBJECTS AND BRIEF SUMMARY OF THE INVENTION

The present invention has for its object the provision of a boiler which uses a damper control system, and yet which operates without an increase in temperature at the outlet of the furnace even if the heating load on the reheaters is increased.

In order to achieve the foregoing object, according to the present invention, there is provided a boiler wherein a combustion gas duct is divided into a plurality of passages, the separate passages being provided with reheaters and superheaters, the combustion gas flow through each passage being adjustable, and in which convective evaporators are provided downstream of each of the reheaters in the reheater passages.

In this boiler, the convective evaporators serve as a heat exchanger in the main steam system. With this arrangement, if the combustion gas flow increases in the reheater passages, and heat absorption decreases as a result of which the combustion gas flow decreases in the superheater passages, heat absorption by the convective evaporators increases so that the decrease in the heat absoption by the superheaters is mostly compensated for and kept minimal. Hence, the heat absoption in the main steam system through the convective evaporators to the superheaters remains unchanged and steam temperature at the outlet of the furnace water-wall is maintained at a desired sufficiently low level.

BRIEF DESCRIPTION OF THE DRAWING

The invention will now be described in connection with the accompanying drawing, which is a schematic sectional elevation of a boiler according to the invention.

DETAILED DESCRIPTION OF THE DRAWING

The drawing shows one embodiment of a boiler according to the present invention, which boiler is a double reheat boiler operable at supercritical pressure.

The boiler furnace 1 has a combustion gas duct 2 extending therefrom, the downstream end of which is divided into three passages 2*a*, 2*b* and 2*c* by means of vertical baffle walls 3. Each of the passages 2*a* to 2*c* is provided with a damper 4 for controlling combustion gas flow. The amount of combustion gas flowing through the passages 2*a* to 2*c* is regulated by controlling the respective dampers 4. Provided downstream of the dampers 4 is an economizer 5. Alternatively, the dampers 4 may be provided at the outlet of the economizer 5.

The middle passage 2*b* is provided with a primary reheater 6*a* forming part of a first-stage reheater, i.e. a high pressure reheater. Provided at the outlet of the furnace 1 at the upstream end of the duct 2 is a secondary high pressure reheater 6*b* connected to the primary high pressure reheater 6*a* form the first-stage reheater. A low pressure secondstage reheater 7 is provided in the passage 2*a* located on the side of the passage 2*b* closer to the furnace. A primary superheater 8*a* is provided in the passage 2*c* located on the side of the passage 2*b* away from the furnace. Provided at the outlet of the furnace 1 at the upstream end of duct 2 is a secondary superheater 8*b* on the upstream side of the secondary high pressure reheater 6*b* and connected to the primary superheater 8*a*. Further, a tertiary superheater 8*c* is provided on the downstream side of the secondary high pressure reheater 6*b* and is connected to the secondary superheater 8*b*. In the drawing, arrows show the inlets and outlets of each of the reheaters, superheaters, and economizer.

In the present invention, convective evaporators 9 and 10 are respectively provided between the reheater 7 in the passage 2*a* and the reheater 6*a* in the passage 2*b* and the economizer 5, said convective evaporators 9 and 10 serving as heat exchangers in the main steam system.

In the boiler thus constructed, if a large amount of combustion gas is introduced into the passages 2*a* and 2*b* in which the reheaters 7 and 6*a* are respectively provided, the amount of the combustion gas flowing through the passage 2*c* with the primary superheater 8*a* provided therein decreases, and also heat absorption by the primary superheater 8*a* decreases. However, heat absorption will increase in the convective evaporators 9 and 10 located downstream of the reheaters 7 and 6*a* respectively, thereby compensating for the shortage of the heat absorption by the primary superheater 8*a*. Further, steam temperatures are controlled at the outlet of the superheaters and the enthalpy level at the outlet of the furnace 1 is also maintained in a certain level. On the other hand, if the amount of the combustion gas flowing through the primary superheater 8*a* thus increases, the amount of the combustion gas introduced into the passages 2*a* and 2*b* in which the reheaters 7 and 6*a* are respectively provided decreases and the heat absorption by the convective evaporators 9 and 10 also decreases. Thus, the overall heat absorption in the main steam system and the enthalpy level at the outlet of the furnace are maintained at a certain level. Thus, even if the ratio of the amount of combustion gas flowing into the reheaters and superheaters is changed, the deviation of the temperature at the outlet of the furnace will be kept minimal.

While the above described embodiment is a double reheat type boiler having three passages, the invention is also applicable to a single reheat type boiler having two passages.

In the boiler according to the present invention, in the event that the ratio of the amounts of combustion gas flowing into the reheaters and the superheaters is changed and the heat absorption by the superheaters increases or decreases, such increase or decrease is compensated for by the convective evaporators located downstream of the reheaters in the respective passages. Accordingly, deviation of the temperature at the outlet of the furnace is kept minimal so that thermal strain on the water-wall tubes is kept minimal. The walls of the furnace are thus protected. Furthermore, in this boiler, the convective evaporators are located between the reheaters and the economizer, in other words, downstream of the reheaters and upstream of the economizer. Thus, steaming of feedwater at the outlet of the economizer is also prevented.

What is claimed is:

1. A duct system for exhausting combustion gas from a boiler comprising:

a gas discharge duct having an inlet adapted to be connected to a combustion gas outlet of a boiler;

a plurality of passages disposed within said gas discharge duct;

a first reheater disposed in a first one of said passages;

a second reheater disposed in a second one of said passages;

a superheater disposed in a third one of said passages;

a first convective evaporator disposed in said first one of said passages, said first reheater being disposed between said inlet and said first convective evaporator;

a second convective evaporator disposed in said second one of said passages, said second reheater being disposed between said inlet and said second convective evaporator; and means for selectively adjusting a ratio of an amount of combustion gas flow through each of said passages.

2. the duct assembly of claim 1, further comprising an economizer disposed at an outlet end of said gas discharge duct, said first reheater, said second reheater and said superheater being disposed between said inlet and said outlet end of said gas discharge duct.

* * * * *